United States Patent [19]

Watts

[11] 4,061,175

[45] Dec. 6, 1977

[54] PATTERN ASSEMBLY AND METHOD OF MAKING THE SAME

[75] Inventor: Claude H. Watts, Mayfield Heights, Ohio

[73] Assignee: Precision Metalsmiths, Inc., Cleveland, Ohio

[21] Appl. No.: 706,775

[22] Filed: July 19, 1976

[51] Int. Cl.[2] ..... B22C 7/00

[52] U.S. Cl. ..... 164/45; 164/244; 164/246

[58] Field of Search ..... 164/244, 35, 36, 34, 164/246, 45

[56] References Cited

U.S. PATENT DOCUMENTS

| | | | |
|---|---|---|---|
| 2,994,931 | 8/1961 | Operhall et al. | 164/246 |
| 3,186,041 | 6/1965 | Horton | 164/36 X |
| 3,263,286 | 8/1966 | Watts et al. | 164/21 |
| 3,424,227 | 1/1969 | Watts et al. | 164/34 X |
| 3,520,349 | 7/1970 | Watts | 164/244 |
| 3,520,350 | 7/1970 | Watts | 164/244 |

*Primary Examiner*—Ronald J. Shore

*Attorney, Agent, or Firm*—Watts, Hoffmann, Fisher & Heinke Co.

[57] ABSTRACT

For use in the lost pattern process of investment casting, an improved pattern assembly of the type having a pattern supporting center tree or sprue member including a rigid tube surrounded by a sleeve made of a flexible material, characterized by longitudinally spaced, thin bands of pattern material extending around the sleeve at those locations where the patterns are to be attached.

6 Claims, 2 Drawing Figures

PATTERN ASSEMBLY AND METHOD OF MAKING THE SAME

BACKGROUND OF THE INVENTION

The present invention relates generally to the lost pattern process of investment casting, and more specifically to the formation of the pattern assemblies used in such a process.

In the lost pattern process, a pattern assembly is conventionally prepared by attaching a plurality of patterns around a sprue member or center tree to form a branched "set-up". A pouring cup or well is frequently attached to the center tree. The patterns, which are replicas of the parts to be cast in metal and include necessary gates and risers, are made of an expendable material, such as wax, a synthetic resin, or a wax and synthetic resin composition. The pattern set-up is coated or invested with a suitable slurry which is allowed to harden to form a refractory mold. Thereafter, the patterns are destroyed, such as by subjecting the mold to heat or a solvent for the pattern material or both to form the mold cavities.

An improved sprue constuction for use in investment casting processes is disclosed in U.S. Pat. No. 3,520,349 and in U.S. Pat. No. 3,520,350 issued July 14, 1970 to C. H. Watts. A preferred form of the improved sprue construction disclosed in those patents comprises a tube made of cardboard or plastic and a corrugated sleeve around the tube. The corrugated cardboard sleeve has corrugations on its inner side in contact with the tube and a smooth outer surface. In order to locate the positions of the patterns to be attached to the sprue member, a sheet of perforated paper on which suitable pattern locating markings are stamped or otherwise printed may be wrapped around the outer surface of the corrugated cardboard sleeve. A thin coating of wax is applied to the perforated paper in order to secure it to the underlying corrugated cardboard sleeve and also to provide a wax surface to which the patterns can be conveniently attached. In the case of small diameter sprue constructions, such as are used when the sprue cavity in the mold is to be cast solid with metal, the corrugated cardboard sleeve may be replaced by a sheet of heavy paper having a very thin wax coating on its outer surface, the perforated paper having the pattern locating markings being applied over the heavy paper as previously described.

Although both of the sprue constructions described above work well in most instances, a problem can arise when they are used for mounting large, heavy patterns. Heavy patterns may cause some flexing of the sleeve whether it is made of heavy wax-coated paper or corrugated cardboard, and this flexing may permit the patterns to come loose from the sprue member so that refractory slurry penetrates beneath them and becomes a source of dirt in the metal castings. The patterns may even become so loose as to fall off of the set-up during processing.

As a practical matter, it is not desirable to attempt to correct the flexing problem by applying a thick layer of wax over the flexible cardboard or paper sleeve. The inner diameter of the mold passage formed by the sprue member is determined by the thickness of the wax layer, and the thickness is more easily controlled by applying a very thin coating. The dimension of the sprue passage in the mold is important because it usually must mate with a core or a plug at one end to prevent metal leakage. When a core is disposed in the sprue passage of the mold as disclosed in U.S. Pat. No. Re. 26,495, the critical spacing between the core and the inside of the mold depends upon the thickness of the wax layer on the sprue and needs to be accurately controlled. Another reason why it is undesirable to use a thick wax coating on the sprue construction is that it is desired to peel the flexible sleeve and the perforated paper from the inside of the mold to promote the pattern removal operation. It is also desired to reduce contamination of the melted pattern material with paper or cardboard in order that the pattern material can be reclaimed conveniently.

SUMMARY OF THE INVENTION

The object of the present invention is to prevent flexing of the sleeve of corrugated cardboard or heavy paper in sprue constructions of the type described above when used to mount large, heavy patterns.

It has been found that flexing of the heavy paper or corrugated cardboard sleeve can be eliminated or materially reduced by providing the sprue construction with bands of strong pattern material at those locations where the patterns are to be attached. The patterns are then attached to the bands rather than directly to the thin wax coating on the exterior of the sprue construction as has been conventional.

The bands are strong enough to prevent harmful flexing of the heavy paper or corrugated cardboard sleeves and provide a superior surface for attaching the patterns. At the same time, the provision of the thin, spaced bands does not significantly increase the inner diameter of the sprue passage of a mold formed around the sprue member or increase the amount of metal required to fill the sprue passage. The presence of the bands does not affect at all the inner dimension of the sprue passage where it mates with a core or sealing plug.

Other advantages and a fuller understanding of the invention will be had from the following detailed description and the accompanying drawing.

DESCRIPTION OF THE PREFERRED EMBODIMENT

Figure 1:
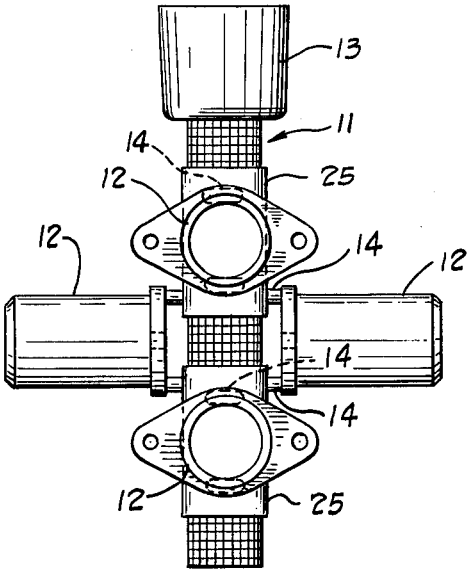
FIG. 1 is an elevational view of a pattern assembly embodying the present invention.

Referring to the drawing, and to FIG. 1 in particular, a pattern set-up is generally designated by reference numeral 10. The set-up 10 is comprised of a center tree or sprue member 11 and workpiece or casting patterns 12 mounted around the outside of the sprue member 11 in a manner to be described in more detail. A pouring cup or well member 13 is shown attached to one end of the sprue member 11, although it is to be understood that the use of a pouring cup is optional.

In accordance with conventional practice, the workpiece or casting patterns 12 may be formed of an expendable material such as wax, a synthetic resin, or a wax and synthetic resin composition. The patterns 12 duplicate the parts to be cast in metal and include the necessary gates 14.

Figure 2:
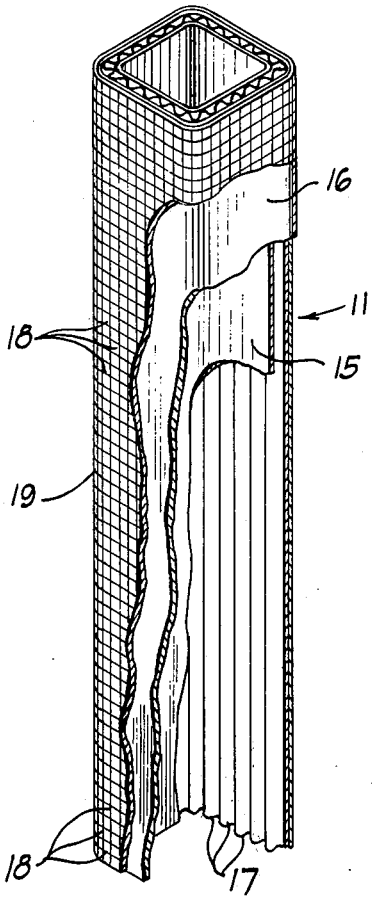
FIG. 2 is a perspective view of the sprue member with portions broken away.

The construction of the sprue member 11 is shown in FIG. 2 to comprise a rigid tube 15 made of cardboard or plastic and a surrounding sleeve 16 made of a flexible material which is capable of deforming under the weight of patterns attached directly to it. In the illustrated construction of the sprue member 11, the sleeve 16 is made of corrugated cardboard and has axial corrugations 17 only in its inner surface, while the outer wall surface of the sleeve is smooth. The corrugated structure of the sleeve 16 is such that the tube 15 can be easily removed from the sleeve after the pattern assembly or set-up 10 has been used to form a mold. After removal of the tube 15, the corrugated cardboard sleeve 16 can be peeled from the inner surface of the mold to expose the gate ends of the patterns 12 and thereby facilitate the pattern removal operation which follows. In the case of small diameter sprue members such as are used to make molds in which the sprue passages are cast solid with metal, the corrugated cardboard sleeve 16 may be replaced by a sheet of heavy paper which is wrapped around the outside of the tube 15 and provided with a thin wax coating on its outer surface.

The outside of the sprue member 11 is provided with visible markings which aid in locating the desired positions of the workpiece patterns. As shown, the pattern locating markings are in the form of grid lines 18. Alternatively, the pattern locating markings may consist of spaced rectangles or the like that designate where the patterns are to be attached for proper spacing and orientation. The pattern locating markings may be imposed on the sprue member 11 in several different ways. A preferred technique is to provide a sheet of perforated paper 19 on which the grid lines 18 or rectangles (not shown) are stamped or otherwise printed, as by photocopying.

The illustrated construction of the sprue member 11 is formed by placing the corrugated sleeve 16 around the rigid tube 15 and wrapping the paper 19 around the sleeve. This assembly is then provided with a thin outer coating of a low melting point wax (not shown). The wax can be coated on the paper 19 by rotating the sprue member on a horizontal axis in a molten wax bath. The wax coating penetrates the perforations of the paper 19 and secures it to the underlying corrugated cardboard sleeve 16.

In accordance with the present invention, the sprue member 11 is additionally provided with one or more thin, preformed bands 25 made of a strong, expendable pattern material such as disclosed in U.S. Pat. No. 3,263,286, the disclosure of which is incorporated by reference. The preformed bands 25 are slipped over the wax-coated sprue member 11 and are sealed in place at longitudinally spaced locations where the patterns 12 are to be attached. The gates 14 of the patterns 12 are then attached to the bands 25 rather than directly to the wax-coated sprue member as has been done in the past.

The thickness of the bands 25 is kept to a minimum and is only that which is sufficient to prevent harmful flexing of the sleeve 16 under the weight of the patterns 12 and to provide strong supporting surfaces for mounting the patterns. In preferred constructions, the thickness of the bands 25 is in the range from 1/16th to 1/8th inch. It will be apparent that the provision of the thin bands 25 will not significantly increase the inner diameter of the sprue passage of a mold formed around the sprue member 11 or increase the amount of metal required to fill the sprue passage of the mold. Further, the presence of the bands 25 does not affect at all the critical inner dimension of the mold sprue passage where it mates with a core or sealing plug. It will also be seen, that, since the bands 25 are only applied in limited number of locations, they will not interfere with the removal of the paper 19 and the underlying sleeve 16 from the mold.

The mounting bands 25 are made in whatever configuration is needed to fit the shape of the specific sprue member employed for a particular operation. As shown, the bands 25 are of a rectangular configuration, but they also can be cylindrical, triangular, etc.

Many modifications and variations of the invention will be apparent to those skilled in the art in light of the foregoing detailed disclosure. Therefore, it is to be understood that, within the scope of the appended claims, the invention can be practiced otherwise than as specifically shown and described.

I claim:

1. A pattern set-up for use in the lost pattern process of investment casting comprising:

a. a sprue member including a sleeve, b. preformed, thin mounting bands extending around said sleeve and attached thereto at spaced locations along its length, said bands being made of an expendable pattern material, and c. at least one workpiece pattern attached to said bands, d. said bands being of a thickness sufficient to prevent flexing of said sleeve under the weight of said pattern.

2. A pattern set-up as claimed in claim 1 in which the thickness of said bands is in the range of from about 1/16th to about ⅛th of an inch.

3. A pattern set-up for use in the lost pattern process of investment casting comprising:

a. a sprue member including a tube and a surrounding sleeve made of flexible material, said sprue member being provided with an outer coating of wax, b. a plurality of preformed, thin bands assembled around said sleeve at spaced locations along its length, and c. a plurality of workpiece patterns attached to said bands, d. said bands being made of an expendable pattern material and having a thickness sufficient to prevent flexing of said sleeve.

4. A pattern set-up as claimed in claim 3 wherein the thickness of said bands is in the range of from about 1/16 to about ⅛th of an inch.

5. In a pattern set-up of a sprue member and a plurality of casting patterns for use in the lost pattern process of investment casting, said sprue member including a tube surrounded by a flexible sleeve and a thin wax coating, the improvement comprising a plurality of thin, preformed bands made of an expendable pattern material assembled around said sprue member and secured thereto at spaced locations along its length, said casting patterns being connected to and supported by said bands, and said bands having a thickness sufficient to prevent flexing of said sleeve.

6. A method of making a pattern set-up of a sprue member and a plurality of casting patterns for use in the lost pattern process of investment casting comprising the steps of:

a. constructing a sprue member including a tube surrounded by a flexible sleeve and a thin outer coating of wax, b. forming a plurality of thin bands made of an expendable pattern material, c. thereafter assembling said bands around said sprue member at spaced locations along its length, and d. attaching said casting patterns to said bands.

* * * * *